United States Patent [19]

Soucy et al.

[11] 3,931,690

[45] Jan. 13, 1976

[54] ACTION BAR-ACTION SPRING LINK USING FLEXIBLE WIRE

[75] Inventors: Kenneth Wilfred Soucy, Richfield Springs; Thomas James Plunkett, Ilion; Kenneth Charles Rowlands, Utica, all of N.Y.

[73] Assignee: Remington Arms Company, Inc., Bridgeport, Conn.

[22] Filed: Mar. 8, 1974

[21] Appl. No.: 449,226

[52] U.S. Cl. ..... 42/16; 89/199

[51] Int. Cl.[2] ..... F41C 11/00; F41D 11/12

[58] Field of Search ..... 42/16; 89/198, 199, 177, 89/178

[56] References Cited

UNITED STATES PATENTS

| | | | |
|---|---|---|---|
| 908,631 | 1/1909 | Warnant-Creon | 42/16 |
| 1,057,329 | 3/1913 | Clarus | 89/199 |
| 1,071,023 | 8/1913 | Borchardt | 89/198 |
| 1,298,912 | 4/1919 | Dibovsky | 89/199 |
| 2,570,772 | 10/1951 | Crittendon | 42/16 |
| 2,780,145 | 2/1957 | Saive | 42/16 |

*Primary Examiner*—Samuel Feinberg
*Assistant Examiner*—C. T. Jordan
*Attorney, Agent, or Firm*—John H. Lewis, Jr.; Nicholas Skovran

[57] ABSTRACT

A system for transferring the forces between reciprocably mounted firearm action bars (and a bolt assembly connected thereto) and an action spring mounted in the gun stock. A flexible wire link connects the action spring and the action bars so that rearward movement of the action bars to the breech open position causes biasing of the action spring whereupon the action spring now urges the action bars forwardly to breech closed position.

10 Claims, 4 Drawing Figures

ACTION BAR-ACTION SPRING LINK USING FLEXIBLE WIRE

This invention relates generally to a firearm of the type which is automatically reloaded and made ready for subsequent firing by either utilizing the energy of recoil imparted to a movably mounted barrel, or by utilizing a portion of the explosive gases to move the reciprocating action bars and bolt assembly rearwardly into breech open position. Some typical U.S. Pats. showing firearms of this type are Hepburn, No. 918,447; Crittendon, No. 2,570,772; and Saive, No. 2,780,145.

More specifically, this invention relates to a novel system of transferring the forces between the reciprocably mounted action bars and bolt assembly and an action spring mounted in the gun butt stock.

It is an object of this invention to provide an improved, flexible wire linkage between the reciprocably mounted action bars and bolt assembly and an action spring, wherein the action spring is biased by the rearward movement of the action bars.

It is a further object of this invention to provide a flexible wire linkage between the action bars and action spring which will have adequate part life and which does not take up much space, thus avoiding parts congestion within the frame of the gun.

Other objects and advantages will appear from consideration of the specification and claims, referring to the attached drawings in which:

Figure 1:
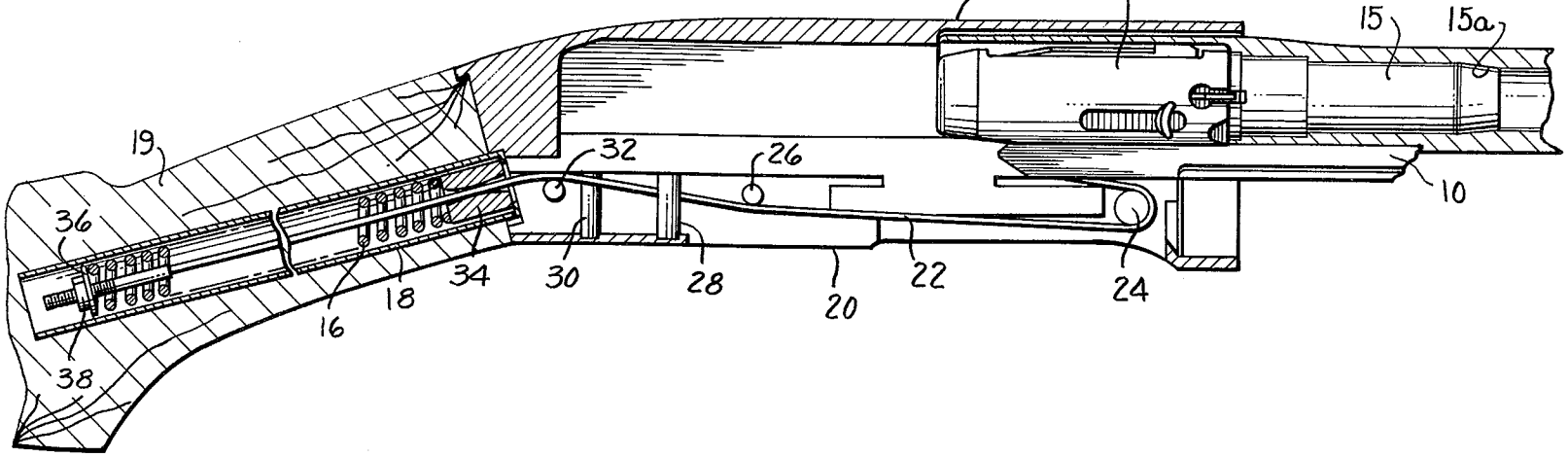
FIG. 1 is a side elevation of a portion of a firearm showing the action in the forward breech closed position.

It is to be understood that when the term "automatic firearm" is used herein that it is the intent that this term includes not only firearms which are fully automatic, i.e. will fire continuously as long as the trigger remains depressed and ammunition is available, but also includes such firearms which today are sometimes known as "semi-automatic" or "autoloading", i.e. where the trigger must be actuated for each firing cycle. In either case, the action is cocked and made ready to fire by either utilizing the gun recoil or by using part of the explosive gases in the barrel to move the action rearwardly after firing.

When the action bars 10 and bolt assembly 12 of an automatic firearm 14 are brought to their rearmost position after the firing of a round (see FIG. 2), some means must be provided for feeding the next cartridge 15 into the chamber 15a and for returning the action bars and bolt assembly to their forward, breech closing position.

An action spring 16 is contained in the action spring tube 18 which is positioned in stock 19 and which extends from the rear of the gun frame 20 to provide the force required to return the action bars 10 and bolt assembly 12 to the forward-most or breech closing position. The bolt assembly 12, which includes the firing pin (not shown), is mounted to the action bars 10 and moves therewith reciprocably between the forward breech closed position (FIG. 1) to a rearward breech open position (FIG. 2). As mentioned above, the force which moves the action bars and bolt assembly rearwardly to the breech open position can be provided by gun recoil or by bleeding off explosive gas pressure from the barrel of the gun. The force which moves the action bars and bolt assembly to a forward breech closed position is provided by the action spring 16.

Thus far, the construction described above is conventional. Moreover, the Hepburn and Crittendon patents, cited above, disclose rigid links connecting the action spring and the reciprocating bolts, while the Saive patent, also cited above, discloses a rigid rod link connecting these parts.

The present invention utilizes a novel flexible wire link 22 to transfer the force of the action spring 16 to the action bars 10 and attached bolt assembly 12. The forward end of wire link 22 is attached to the action bars 10 and runs forward through a slot (not shown) in the action bar to the wire link forward guide pin 24. There it makes a 180° turn and runs rearwardly along the inside surface of the frame 14. Near the rear of the frame, it goes around rear wire link guide pins 26, 28, 30, and 32 and enters the action spring tube 18. In its entrance to the action spring tube, the wire link 22 is guided by an action spring stop 34 which, in addition to acting as a stop for the action spring 16, locates the wire link 22 centrally in the action spring tube. The wire link is then connected to the rear of the action spring by means of a wire link connecting washer 36 and a wire link connecting nut 38 completing the assembly.

Figure 2:
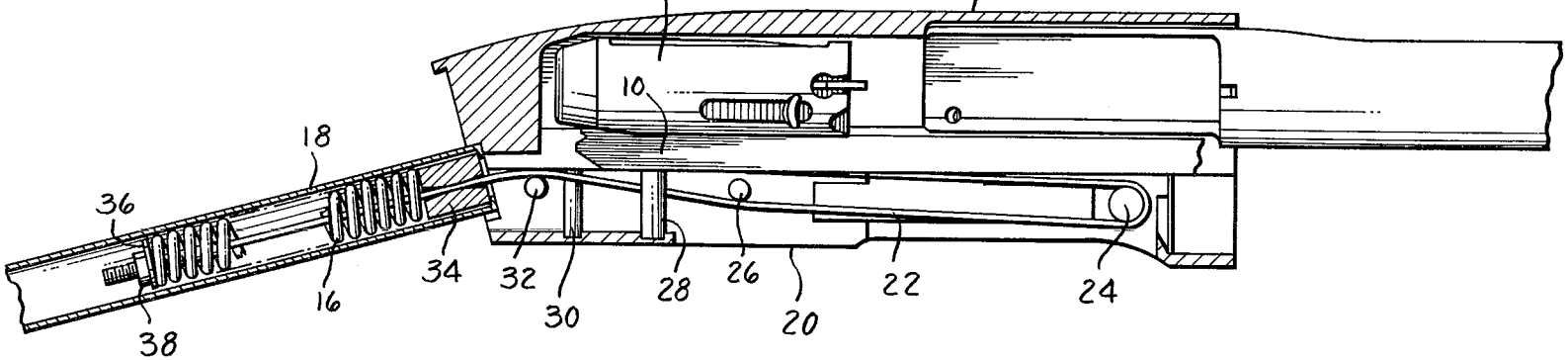
FIG. 2 is a side elevation of a portion of the firearm shown in FIG. 1 showing the action in a breech open position.
Figure 3:
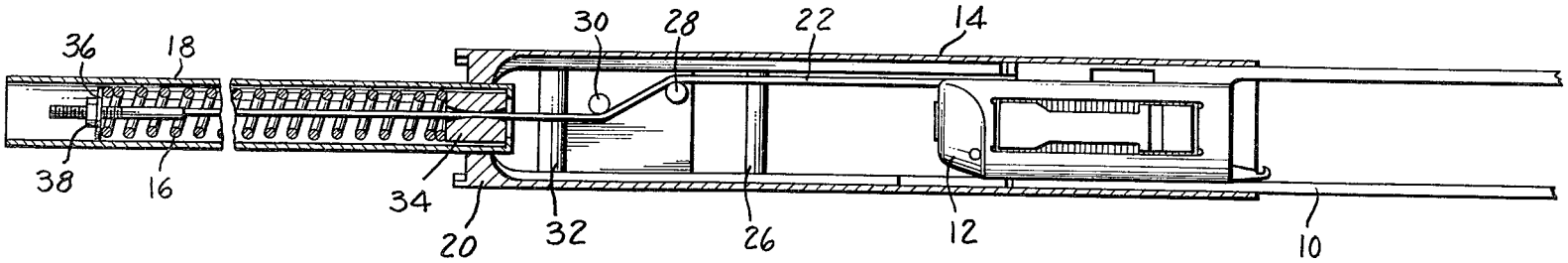
FIG. 3 is a plan view of the firearm shown in FIG. 1.

The description outlined above refers to the use of a compression action spring as shown in FIGS. 1 through 3. It is possible, however, to use an extension type of action spring as shown in FIG. 4.

Figure 4:
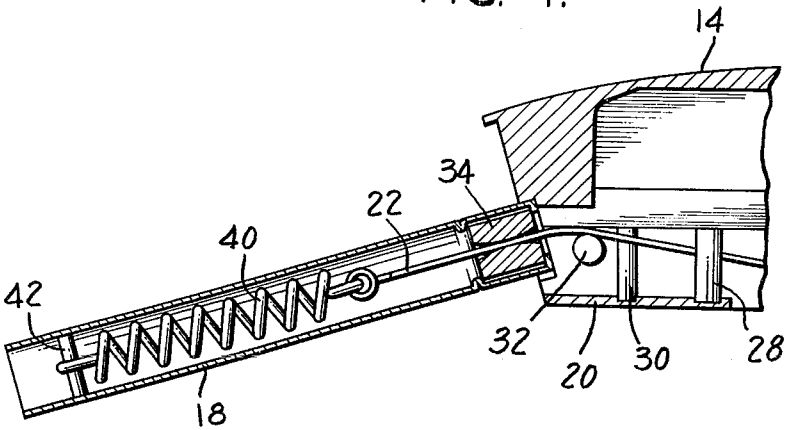
FIG. 4 is a sectional view of the action spring tube showing a modified action spring, in this case an extension spring in place of the compression spring shown in FIGS. 1-3.

In the modification shown in FIG. 4, the flexible wire link 22 is connected at its forward end in the same manner as shown in FIG. 1. The rear end of the wire link enters the action spring tube 18 and is guided by an action spring stop 34, again as shown in FIG. 1. The wire link 22 is then attached to the forward end of an extension spring 40, the rear end of which is connected to the action spring tube by means of an extension spring retainer 42, in this case a cross pin.

As will be understood, when the action moves rearwardly to the breech open position, the wire link is moved forwardly so that the extension spring 40 is elongated and put in tension. When the action is at its rearmost position, the spring 40, supported at its rear end and pulled forwardly at its forward end, is biased to move the wire link rearwardly and thus to move the action bar and bolt assembly forwardly into breech closed position.

Flexible wire link 22 can be any type of flexible wire which has high strength, e.g. impact and wear, characteristics. Generally, the preferred type will be wire composed of metal strands twisted to form a high strength wire, and preferably coated with a suitable plastic, such as nylon. A nylon coated wire has been successfully tested in an altered 12 gauge shotgun. Other plastics, such as fluorcarbon, would also be expected to be suitable for this purpose.

The nylon coated flexible wire provides for (1) less operating friction; (2) more wear resistance; and (3) greater endurance life of wire.

In addition to the nylon coating assisting in decreasing the amount of operating friction, it should be understood that the friction can be decreased by hardening and polishing the forward guide pin 24 as well as the wire link guide pins 26, 28, 30, and 32.

The following description of the cycle of operation refers to the preferred compression type of action spring as shown in FIGS. 1–3.

Our description will begin with the action in its forward-most breech closed position, as shown in FIG. 1. After the round is fired, the action, i.e. bars 10 and bolt assembly 12, starts its movement to the rear under the influence of gun recoil or explosive gases. In doing this, the action pulls the wire link forwardly which in turn pulls on the rear of the action spring, bringing it forward and thus compressing it. As the action reaches its rearmost or breech open position (FIG. 2), the action spring is compressed to its fully loaded position. The compressed action spring then pulls on the wire link which in turn pulls the action forward and returns it to the forward-most or breech closed position (FIG. 1).

The above system is described as using one wire link. It should also be noted that two wire links could be used, having one on either side of the gun and both being the mirror image of the other.

What is claimed is:

1. In a firearm having a barrel, a chamber in said barrel for receiving a cartridge, a receiver frame attached to said barrel and a gun stock attached to said frame, a breech bolt means mounted in said frame for reciprocable movement between a forward breech closing position and a rearward breech open position, action spring means mounted in said gun stock, and flexible wire means connected at one end to said action spring means and at the other end to said bolt means, a stationary guide means mounted on said frame for guiding said wire means so that upon rearward movement of said bolt means into breech open position, said spring means is biased to resist the rearward movement of said bolt means and to urge the bolt means forwardly into breech closed position.

2. In a firearm having a barrel, a chamber in said barrel for receiving a cartridge, a receiver frame attached to said barrel and a gun stock attached to said frame, a breech bolt means mounted in said frame for reciprocable movement between a forward breech closing position and a rearward breech open position, action spring means mounted in said gun stock, and flexible wire means connecting said action spring means and said bolt means so that upon rearward movement of said bolt means into breech open position, said spring means is biased to resist the rearward movement of said bolt means and to urge the bolt means forwardly into breech closed position, a forward guide means mounted on said frame forwardly of the connection of said flexible wire means to said breech bolt means, rear guide means mounted on said frame between said forward guide means and said action spring means, said flexible wire means being operatively connected to said bolt means and extending forwardly therefrom to run over said forward guide means, where said wire means makes a 180° turn to run rearwardly along said frame and on said rear guide means and finally being connected to said action spring means.

3. In a firearm as recited in claim 2 wherein said action spring means comprises an action spring tube mounted in said gun stock, an extension action spring positioned in said tube, said spring having its rear end connected at the rear of the action spring tube and its forward end connected to the rear end of said flexible wire means so that upon rearward movement of said breech bolt means to the breech open position, the flexible wire means is pulled forwardly to place the action spring in tension.

4. In a firearm as recited in claim 2 wherein said action spring means comprises an action spring tube mounted in said gun stock, a compression action spring positioned in said tube, said compression spring having its forward end supported at the front of said tube and its rear end connected to the rear end of said flexible wire means so that upon rearward movement of said breech bolt means to the breech open position, the flexible wire means is pulled to put the action spring in compression.

5. In a firearm as recited in claim 2 wherein said flexible wire means is coated with a plastic material.

6. In a firearm as recited in claim 5 wherein said plastic material is nylon.

7. In an automatic firearm having reciprocable action bars and a bolt assembly connected thereto, an action spring located rearwardly of said action bars and bolt assembly, a system for transferring the force of the action spring to the action bars and bolt assembly comprising: a flexible wire link connecting said action spring and said action bars and bolt assembly, guide means guiding the movement of said flexible wire link so that upon rearward movement of said action bars and bolt assembly to breech open position, said flexible wire link moves to bias said action spring which then tends to pull the flexible wire and thus urge the action bars and bolt assembly forwardly into breech closing position.

8. In an automatic firearm as recited in claim 7 wherein said action spring is an extension spring which is put in tension by the rearward movement of said action bars and bolt assembly.

9. In an automatic firearm as recited in claim 7 wherein said action spring is a compression spring which is put in compression by the rearward movement of said action bars and bolt assembly.

10. In an automatic firearm as recited in claim 7 wherein said flexible wire link is coated with plastic material.

* * * * *